United States Patent [19]

Anderson et al.

[11] Patent Number: 5,006,451

[45] Date of Patent: Apr. 9, 1991

[54] PHOTOGRAPHIC SUPPORT MATERIAL COMPRISING AN ANTISTATIC LAYER AND A BARRIER LAYER

[75] Inventors: Charles C. Anderson, Rochester; Diane E. Kestner, Hilton; Mark A. Lewis, Fairport; Gary R. Opitz, Rochester, all of N.Y.

[73] Assignee: Eastman Kodak Company, Rochester, N.Y.

[21] Appl. No.: 523,081

[22] Filed: May 14, 1990

Related U.S. Application Data

[63] Continuation-in-part of Ser. No. 391,906, Aug. 10, 1989, abandoned.

[51] Int. Cl.[5] ..... G03C 1/85

[52] U.S. Cl. ..... 430/527; 430/530; 430/533

[58] Field of Search ..... 430/527, 530, 533

[56] References Cited

U.S. PATENT DOCUMENTS

| | | | |
|---|---|---|---|
| 3,245,833 | 4/1964 | Trevoy | 117/201 |
| 3,963,498 | 6/1976 | Trevoy | 96/87 |
| 4,203,769 | 5/1980 | Guestaux | 430/631 |
| 4,308,332 | 12/1981 | Upson et al. | 430/62 |
| 4,407,938 | 10/1983 | Mizukura et al. | 430/533 |
| 4,495,276 | 1/1985 | Takimoto et al. | 430/527 |
| 4,582,781 | 4/1986 | Chen et al. | 430/527 |
| 4,609,617 | 9/1986 | Yamazaki et al. | 430/533 |
| 4,689,359 | 8/1987 | Ponticello et al. | 524/23 |
| 4,810,624 | 3/1989 | Hardam et al. | 430/528 |

FOREIGN PATENT DOCUMENTS 59-229554 12/1984 Japan .

*Primary Examiner*—Jack P. Brammer
*Attorney, Agent, or Firm*—Alfred P. Lorenzo

[57] ABSTRACT

Photographic support materials are comprised of a conventional support, such as polyester film, cellulose acetate film or resin-coated paper, having thereon an antistatic layer comprising vanadium pentoxide and an overlying barrier layer comprised of a latex polymer having hydrophilic functionality. The barrier layer provides excellent adhesion between the antistatic layer and overlying layers, such as silver halide emulsion layers or curl control layers, and also prevents unwanted diffusion of the vanadium pentoxide; whereby the combination of antistatic and barrier layers serves to impart a high level of permanent antistatic protection.

20 Claims, No Drawings

PHOTOGRAPHIC SUPPORT MATERIAL COMPRISING AN ANTISTATIC LAYER AND A BARRIER LAYER

CROSS-REFERENCE TO RELATED APPLICATIONS

This is a continuation-in-part of application Ser. No. 391,906, filed Aug. 10, 1989, and now abandoned.

FIELD OF THE INVENTION

This invention relates in general to photography and in particular to materials useful as supports for photographic elements. More particularly, this invention relates to photographic support materials having a layer which provides protection against the generation of static electrical charges and a barrier layer which overlies such antistatic layer.

BACKGROUND OF THE INVENTION

It has been known for many years to provide photographic elements, including both films and papers, with antistatic protection. Such protection is very important since the accumulation of static electrical charges on photographic elements is a very serious problem in the photographic art. These charges arise from a variety of factors during the manufacture, handling and use of photographic elements. For example, they can occur on sensitizing equipment and on slitting and spooling equipment, and can arise when the paper or film is unwound from a roll or as a result of contact with transport rollers. The generation of static is affected by the conductivity and moisture content of the photographic material and by the atmospheric conditions under which the material is handled. The degree to which protection against the adverse effects of static is needed is dependent on the nature of the particular photographic element. Thus, elements utilizing high speed emulsions have a particularly acute need for antistatic protection. Accumulation of static charges can cause irregular fog patterns in a photographic emulsion layer, and this is an especially sever problem with high speed emulsions. Static charges are also undesirable because they attract dirt to the photographic element and this can cause repellency spots, desensitization, fog and physical defects.

To overcome the adverse effects resulting from accumulation of static electrical charges, it is conventional practice to include an antistatic layer in photographic elements. Typically, such antistatic layers are composed of materials which dissipate the electrical charge by providing a conducting surface. A very wide variety of antistatic agents are known for use in antistatic layers of photographic elements. For example, U.S. Pat. No. 2,649,374 describes a photographic film comprising an antistatic layer in which the antistatic agent is the sodium salt of a condensation product of formaldehyde and naphthalene sulfonic acid. An antistatic layer comprising an alkali metal salt of a copolymer of styrene and styrylundecanoic acid is disclosed in U.S. Pat. No. 3,033,679. Photographic films having an antistatic layer containing a metal halide, such as sodium chloride or potassium chloride, as the conducting material, a polyvinyl alcohol binder, a hardener, and a matting agent are described in U.S. Pat. No. 3,437,484. In U.S. Pat. No. 3,525,621, the antistatic layer is comprised of colloidal silica and an organic antistatic agent such as an alkali metal salt of an alkylaryl polyether sulfonate, an alkali metal salt of an arylsulfonic acid, or an alkali metal salt of a polymeric carboxylic acid. Use in an antistatic layer of a combination of an anionic film forming polyelectrolyte, colloidal silica and a polyalklene oxide is disclosed in U.S. Pat. No. 3,630,740. In U.S. Pat. No. 3,655,386, the surface conductivity of photographic film is improved by coating it with an aqueous alcohol solution of sodium cellulose sulfate. In U.S. Pat. No. 3,681,070, an antistatic layer is described in which the antistatic agent is a copolymer of styrene and styrene sulfonic acid. U.S. Pat. No. 4,542,095 describes antistatic compositions comprising a binder, a nonionic surface-active polymer having polymerized alkylene oxide monomers and an alkali metal salt. In U.S. Pat. No. 4,623,594, an antistatic layer is formed by curing a composition comprising an electron radiation curable prepolymer and an electron radiation reactive antistatic agent that is soluble in the prepolymer.

It is known to prepare an antistatic layer from a composition comprising vanadium pentoxide as described, for example, in Guestaux, U.S. Pat. No. 4,203.769 issued May 20, 1980. Antistatic layers which contain vanadium pentoxide provide excellent protection against static and are highly advantageous in that they have excellent transparency and their performance is not significantly affected by changes in humidity. It is also known to provide such vanadium pentoxide antistatic layers with a protective overcoat layer that provides abrasion protection and/or enhances frictional characteristics, such as a layer of a cellulosic material.

In some types of photographic elements, the antistatic layer is located on the side of the support opposite to the image-forming layers and it is not necessary for there to be any functional layers overlying the antistatic layer, except for the optional inclusion of a protective overcoat layer. Vanadium pentoxide antistatic layers, with or without the inclusion of polymeric binders, are very effectively employed with such elements, and may serve as the outermost layer or, optionally, may be provided with an overlying cellulosic layer which serves as a protective abrasion-resistant topcoat layer. In other types of photographic elements, however, the antistatic layer must function as both a subbing layer and an antistatic layer. Thus, for example, many photographic elements utilize, on the side of the support opposite to the image-forming layers, a gelatin-containing pelloid layer which functions to control curl. With such elements, it is typical to employ a layer underlying the curl control layer which functions as both a subbing layer and an antistatic layer. Other photographic elements, such as X-ray films, are coated with silver halide emulsion layers on both sides and are provided with a layer which functions as both a subbing layer and antistatic layer underlying each silver halide emulsion layer. Serious difficulties are encountered when vanadium pentoxide antistatic layers are utilized as subbing layers. Thus, for example, silver halide emulsion layers and curl control layers do not adhere well to the vanadium pentoxide antistatic layer and, in consequence, delamination can occur. Moreover, the vanadium pentoxide can diffuse from the subbing layer through the overlying emulsion layer or curl control layer into the processing solutions and thereby result in diminution or loss of the desired antistatic protection.

It is toward the objective of providing a photographic support material, utilizing a vanadium pentoxide antistatic layer, which does not suffer from the aforesaid adhesion and diffusion problems that the present invention is directed.

SUMMARY OF THE INVENTION

In accordance with this invention, a photographic support material comprises a support, such as a polyester, cellulose acetate or resin-coated paper support, having thereon an antistatic layer comprising vanadium pentoxide and a barrier layer which overlies the antistatic layer and is comprised of a latex polymer having hydrophilic functionality. The barrier layer prevents the vanadium pentoxide from diffusing out of the underlying antistatic layer and thereby provides permanent antistatic protection. Moreover, the barrier layer provides excellent adhesion, both to the antistatic layer which underlies it and to the emulsion layer or curl control layer which overlies it.

DESCRIPTION OF THE PREFERRED EMBODIMENTS

Photographic elements which can be effectively protected against static by means of the combination of antistatic layer and barrier layer described herein can differ greatly in structure and composition. For example, they can vary greatly in regard to the type of support, the number and composition of the image-forming layers, the kinds of auxiliary layers that are present, the particular materials from which the various layers are formed and so forth.

The useful photographic elements include elements prepared from any of a wide variety of photographic supports. Typical photographic supports include polymeric film, wood fiber—e.g., paper, metallic sheet and foil, glass and ceramic supporting elements, and the like.

Typical of useful polymeric film supports are films of cellulose nitrate and cellulose esters such as cellulose triacetate and diacetate, polystyrene, polyamides, homo- and co-polymers of vinyl chloride, poly(vinylacetal), polycarbonate, homo and co-polymers of olefins, such as polyethylene and polypropylene and polyesters of dibasic aromatic carboxylic acids with divalent alcohols, such as poly(ethylene terephthalate).

Typical of useful paper supports are those which are partially acetylated or coated with baryta and/or a polyolefin, particularly a polymer of an alpha-olefin containing 2 to 10 carbon atoms in the repeating unit, such as polyethylene, polypropylene, copolymers of ethylene and propylene and the like.

Polyester films, such as films of polyethylene terephthalate, have many advantageous properties, such as excellent strength and dimensional stability, which render them especially advantageous for use as supports in the present invention.

The polyester film supports which can be advantageously employed in this invention are well known and widely used materials. Such film supports are typically prepared from high molecular weight polyesters derived by condensing a dihydric alcohol with a dibasic saturated fatty carboxylic acid or derivatives thereof. Suitable dihydric alcohols for use in preparing polyesters are well known in the art and include any glycol wherein the hydroxyl groups are on the terminal carbon atom and contain from 2 to 12 carbon atoms such as, for example, ethylene glycol, propylene glycol, trimethylene glycol, hexamethylene glycol, decamethylene glycol, dodecamethylene glycol, and 1,4-cyclohexane dimethanol. Dibasic acids that can be employed in preparing polyesters are well known in the art and include those dibasic acids containing from 2 to 16 carbon atoms. Specific examples of suitable dibasic acids include adipic acid, sebacic acid, isophthalic acid, and terephthalic acid. The alkyl esters of the above-enumerated acids can also be employed satisfactorily. Other suitable dihydric alcohols and dibasic acids that can be employed in preparing polyesters from which sheeting can be prepared are described in J. W. Wellman, U.S. Pat. No. 2,720,503, issued Oct. 11, 1955.

Specific preferred examples of polyester resins which, in the form of sheeting, can be used in this invention are poly(ethylene terephthalate), poly(cyclohexane 1,4-dimethylene terephthalate), and the polyester derived by reacting 0.83 mol of dimethyl terephthalate, 0.17 mol of dimethyl isophthalate and at least one mol of 1,4-cyclo-hexanedimethanol. U.S. Pat. No. 2,901,466 discloses polyesters prepared from 1,4-cyclohexanedimethanol and their method of preparation.

The thickness of the polyester sheet material employed in carrying out this invention is not critical. For example, polyester sheeting of a thickness of from about 0.05 to about 0.25 millimeters can be employed with satisfactory results.

In a typical process for the manufacture of a polyester photographic film support, the polyester is melt extruded through a slit die, quenched to the amorphous state, oriented by transverse and longitudinal stretching, and heat set under dimensional restraint. In addition to being directionally oriented and heat set, the polyester film can also be subjected to a subsequent heat relax treatment to provide still further improvement in dimensional stability and surface smoothness.

In carrying out the present invention, it is generally advantageous to employ a polymeric subbing layer between a polyester film support and the antistatic layer. Polymeric subbing layers used to promote the adhesion of coating compositions to polyester film supports are very well known in the photographic art. Useful compositions for this purpose include interpolymers of vinylidene chloride such as vinylidene chloride/acrylonitrile/acrylic acid terpolymers or vinylidene chloride/methyl acrylate/itaconic acid terpolymers. Such compositions are described in numerous patents such as for example, U.S. Pat. Nos. 2,627,088, 2,698,235, 2,698,240, 2,943,937, 3,143,421, 3,201,249, 3,271,178, 3,443,950 and 3,501,301. The polymeric subbing layer is typically overcoated with a second subbing layer comprised of gelatin which is typically referred to in the art as a "gel sub".

As described hereinabove, the antistatic layer of this invention comprises vanadium pentoxide as the antistatic agent. The advantageous properties of vanadium pentoxide are described in detail in Guestaux, U.S. Pat. No. 4,203,769. The antistatic layer is typically prepared by the coating of a colloidal solution of vanadium pentoxide. Preferably, the vanadium pentoxide is doped with silver. To achieve improved bonding, a polymeric binder, such as a latex of a terpolymer of acrylonitrile, vinylidene chloride and acrylic acid, can be added to the colloidal solution of vanadium pentoxide. In addition to the polymeric binder and the vanadium pentoxide, the coating composition employed to form the antistatic layer can contain a wetting agent to promote coatability.

The essential component of the barrier layer employed in the support materials of this invention is a latex polymer having hydrophilic functionality. Optional additional components of the barrier layer include gelatin, a coalescing agent, a wetting agent, matte particles and a cross-linking agent. The purpose of using gelatin is to aid in controlling the hydrophilic/hydrophobic balance so as to simultaneously obtain both excellent barrier performance and excellent adhesion. Gelatin is usefully employed in amounts of up to about twenty-five percent of the combined weight of gelatin and latex polymer. The coalescing agent is employed to aid in forming a high quality continuous film that is effective as a barrier. The purpose of including the wetting agent is to promote coatability. Matte particles, such as colloidal silica or beads of polymeric resins such as polymethylmethacrylate, can be used to reduce the tendency for blocking to occur when the photographic support material is wound in roll form. If desired, a cross-linking agent can be employed to cross-link the latex polymer and thereby render the barrier layer more durable. A particularly useful material for this purpose is hexamethoxy methyl melamine.

Latex polymers having hydrophilic functionality and their use in photograpic elements are well known in the art. Such polymers and photographic elements containing them are described, for example, in Ponticello et al, U.S. Pat. No. 4,689,359 issued Aug. 25, 1987.

Preferred latex polymers for the purposes of this invention are copolymers of (1) one or more polymerizable monomers selected from the group consisting of styrene, alkyl acrylates and alkyl methacrylates with (2) one or more substituted polymerizable monomers selected from the group consisting of styrenes, alkyl acrylates and alkyl methacrylates that have been substituted with a hydrophilic functional group such as an aminoalkyl salt group or an hydroxyalkyl group.

Examples of Group (1) comonomers include:

styrene
ethyl acrylate
ethyl methacrylate
butyl acrylate
butyl methacrylate
and the like.

Examples of Group (2) comonomers include:

2-aminoethyl methacrylate hydrochloride
2-hydroxyethyl acrylate
2-hydroxyethyl methacrylate
N-(3-aminopropyl)methacrylate hydrochloride
p-aminostryrene hydrochloride
and the like.

Examples of preferred latex polymers for the purposes of this invention include:

poly(ethyl acrylate-co-2-aminoethyl methacrylate hydrochloride-co-2-hydroxyethyl methacrylate),
poly(ethyl acrylate-co-styrene-co-2-aminoethyl methacrylate hydrochloride),
poly(ethyl acrylate-co-styrene-co-2-aminoethyl methacrylate hydrochloride-co-2-hydroxyethyl methacrylate),
poly(butyl acrylate-co-styrene-co-2-aminoethyl methacrylate hydrochloride),
poly(ethyl acrylate-co-methyl methacrylate-co-2-aminoethyl methacrylate hydrochloride-co-2-hydroxyethyl methacrylate),
poly(ethyl acrylate-co-butyl methacrylate-co-2-aminoethyl methacrylate hydrochloride-co-2-hydroxyethyl methacrylate),
and the like.

An additional preferred class of latex polymer for the purposes of this invention are vinylidene chloride-containing polymers having carboxyl functional groups. Illustrative of such polymers are (1) copolymers of vinylidene chloride and an unsaturated carboxylic acid such as acrylic or methacrylic acid, (2) copolymers of vinylidene chloride and a half ester of an unsaturated carboxylic acid such as the mono methyl ester of itaconic acid, (3) terpolymers of vinylidene chloride, itaconic acid and an alkyl acrylate or methacrylate such as ethyl acrylate or methyl methacrylate, and (4) terpolymers of vinylidene chloride, acrylonitrile or methacrylonitrile and an unsaturated carboxylic acid such as acrylic acid or methacrylic acid. Preferred polymers of this type are those containing at least 50 mole % and more preferably at least 70 mole % of vinylidene chloride. An especially preferred vinylidene-chloride-containing polymer having carboxyl functional groups is a terpolymer of 70 to 90 mole % vinylidene chloride, 5 to 25 mole % methyl acrylate, and 1 to 10 mole % itaconic acid.

The vinylidene chloride-containing polymers described hereinabove, such as the terpolymer of vinylidene chloride, methyl acrylate and itaconic acid, are hydrophobic in nature but nonetheless have hydrophilic functionality since they incorporate hydrophilic carboxyl groups, and thus are intended to be encompassed within the scope of the term "latex polymer having hydrophilic functionality" as employed herein.

In certain instances, it is advantageous to employ the vinylidene chloride-containing polymers having carboxyl functional groups rather than polymers in which the hydrophilic functional group is an aminoalkyl salt group. The reason is that some anionic, non-bleaching or reversibly bleaching dyes employed in emulsion layers or curl control layers of photographic elements can adversely interact with aminoalkyl salt groups. The reaction is believed to involve the acidic groups of the dye molecule and the aminoalkyl salt group, and results in a permanent retention of some dye in the processed element and thus an undesirable dye stain. The degree of dye stain is a function of the dye structure, the amount of dye in the photographic element, the thickness of the barrier layer, and the content of aminoalkyl salt groups in the latex polymer employed in the barrier layer. Use of vinylidene chloride-containing polymers having carboxyl functional groups in the barrier layer is especially advantageous, since such polymers do not interact with anionic dyes present in emulsion or curl control layers of photographic elements so that the problem of dye stain is effectively avoided.

Barrier layers comprised of a vinylidene chloride-containing polymer having carboxyl functional groups preferably also contain both a coalescing agent and a wetting agent. The preferred coalescing agent is ethylene carbonate, and it is preferably added to the latex in an amount of 15 to 30% based on latex polymer weight. Other high boiling, water-soluble, organic compounds that are compatible with the latex polymer, such as glycerol or N-methyl pyrrolidone, can be used as the coalescing agent. A variety of anionic or non-ionic wetting agents can be added to the formulation to improve coatability, such as, for example, saponin or a p-nonyl phenoxy polyglycidol. Such wetting agents are advantageously employed in an amount of about 0.03 to about 0.10 percent, based on the total weight of coating solution used to form the barrier layer.

The antistatic layer comprising vanadium pentoxide and the overlying barrier layer can be coated at any suitable coverage, with the optimum coverage of each depending on the particular photographic product involved. Typically, the antistatic layer is coated at a dry weight coverage of from about 1 to about 25 milligrams per square meter. Typically, the barrier layer is coated at a dry weight coverage of from about 100 to about 1,000 milligrams per square meter.

Emulsions containing various types of silver salts can be used to form the silver halide layers, such as silver bromide, silver iodide, silver chloride or mixed silver halides such as silver chlorobromide, silver bromoiodide or silver chloroiodide. Typically silver halide emulsions are taught in patents listed in *Product Licensing Index*, Vol. 92, Dec. 1971, publication 9232, at page 107.

The silver halide emulsions used in combination with the conductive support of this invention can also contain other photographic compounds such as those taught in *Product Licensing Index*, op. cit., pages 107–110. The photographic compounds include development modifiers that function as speed increasing compounds, such as polyalkylene glycols, and others; antifoggants and stabilizers, such as thiazolium salts, and others; developing agents such as hydroquinone, and others; hardeners, such as aldehydes, and others; vehicles, particularly hydrophilic vehicles, such as gelatin, and others; brighteners, such as stilbenes, and others; spectral sensitizers, such as merocyanines, and others; absorbing and filter dyes, such as those described in Sawdey et al U.S. Pat. No. 2,739,971, issued Mar. 27, 1956, and others; color materials for color photography film elements, such as color-forming couplers in U.S. Pat. No. 2,376,679 issued May 22, 1945; and coating aids, such as alkyl aryl sulfonates, and others. The photographic compounds include, also, mixtures of coating aids such as those disclosed in U.S. Pat. No. 3,775,126, issued Nov. 27, 1973, which can be used in simultaneous coating operations to coat hydrophilic colloid layers on the subbing layers of elements intended for color photography, for example, layers of silver halide emulsions containing color-forming couplers or emulsions to be developed in solutions containing couplers or other color-generating materials as disclosed above.

The barrier layer described herein provides greatly improved adhesion of an overlying silver halide emulsion layer, as compared to the poor adhesion that is obtained when a silver halide emulsion layer is coated directly over a vanadium pentoxide antistatic layer. To obtain even further improvement in the adhesion of the silver halide emulsion layer, a very thin gelatin layer can be interposed between the barrier layer and the silver halide emulsion layer. A suitable dry weight coverage for such a thin gelatin layer is about 80 milligrams per square meter.

EXAMPLES 1–32

An aqueous antistatic formulation comprised of 0.025 weight percent silver-doped vanadium pentoxide, 0.025 weight percent of a terpolymer latex of acrylonitrile, vinylidene chloride and acrylic acid and 0.01 weight percent of nonionic surfactant was coated with a doctor blade onto a polyethylene terephthalate film support that had been rubbed with a terpolymer latex of acrylonitrile, vinylidene chloride and acrylic acid. The coating was dried for 5 minutes at 100° C. to form an antistatic layer with a dry weight of approximately 6 milligrams per square meter.

A variety of latex polymers was prepared by emulsion polymerization techniques, using a nonionic surfactant and a cationic initiator, from comonomers identified as follows:

Ae=2-aminoethyl methacrylate hydrochloride
B=butyl acrylate
P=ethyl acrylate
K=butyl methacrylate
Mm=methyl methacrylate
Mn=2-hydroxyethyl methacrylate
S=styrene An aqueous formulation containing about 3 weight percent of the latex polymer, 0.01 weight percent of nonionic surfactant and an amount of gelatin as indicated below was coated over the antistatic layer and then dried for 5 minutes at 100° C. to give a barrier layer dry weight of 750 milligrams per square meter. The barrier layer was then overcoated with 1200 milligrams per square meter of gelatin that was hardened with bis(vinyl sulfonyl methane) hardener.

The test samples were evaluated for adhesion of the gelatin layer to the barrier layer and for permanence of the antistatic properties after processing in conventional film developing and fixing solutions. Dry adhesion was checked by scribing small hatch marks in the coating with a razor blade, placing a piece of high tack tape over the scribed area and then quickly pulling the tape from the surface. The amount of the scribed area removed is a measure of the dry adhesion. Wet adhesion was tested by placing the test sample in developing and fixing solutions at 35° C. for 30 seconds each and then rinsing in distilled water. While still wet, a one millimeter wide line was scribed in the gelatin layer and a finger was rubbed vigorously across the scribe line. The width of the line after rubbing was measured and compared with the original width. To check the permanence of the anitistatic properties, the internal resistivity (at 20% relative humidity) of the test sample was measured before and after treatment in the developing and fixing solutions.

The results obtained are reported in Table I below:

TABLE I

| Example No. | Latex | Ratio of Latex To Gel | Dry Adhesion | Wet Adhesion | Internal Resistivity (log ohms/square) Before Processing | After Processing |
|---|---|---|---|---|---|---|
| 1 | PAeMn 50/5/45 | 100/0 | 0 | 0 | 7.2 | 11.2 |
| 2 | PAeMn 50/5/45 | 85/15 | 0 | 0 | 6.7 | 11.3 |
| 3 | PAeMn 50/5/45 | 80/20 | 0 | 0 | 6.5 | 11.8 |
| 4 | PAeMn 50/15/35 | 100/0 | 0 | 0 | 7.5 | 12.3 |
| 5 | PAeMn 50/15/35 | 85/15 | 0 | 0 | 7.3 | 11.0 |
| 6 | PAeMn 50/15/35 | 80/20 | 0 | 0 | 7.3 | 8.8 |

TABLE I-continued

| Example No. | Latex | Ratio of Latex To Gel | Dry Adhesion | Wet Adhesion | Internal Resistivity (log ohms/square) Before Processing | After Processing |
|---|---|---|---|---|---|---|
| 7 | PSAe 75/20/5 | 100/0 | 7 | ⅓ | 7.0 | 6.5 |
| 8 | PSAe 75/20/5 | 85/15 | 3 | 1 | 7.0 | 6.1 |
| 9 | PSAe 75/20/5 | 80/20 | 0 | 3 | 6.8 | 9.4 |
| 10 | PSAe 65/30/5 | 100/0 | 0 | 0 | 7.4 | 6.7 |
| 11 | PSAe 65/30/5 | 85/15 | 0 | 0 | 7.5 | 9.1 |
| 12 | PSAe 65/30/5 | 80/20 | 0 | 0 | 7.2 | 8.1 |
| 13 | PSAe 50/45/5 | 100/0 | 7+ | 0 | 6.7 | 6.2 |
| 14 | PSAe 50/45/5 | 85/15 | 7+ | 1 | 6.3 | 6.1 |
| 15 | PSAe 50/45/5 | 80/20 | 7 | 2 | 7.5 | 7.1 |
| 16 | PSAeMn 65/20/5/10 | 100/0 | 0 | 0 | 7.0 | 6.5 |
| 17 | PSAeMn 65/20/5/10 | 85/15 | 0 | 0 | 7.4 | 10.3 |
| 18 | PSAeMn 65/20/5/10 | 80/20 | 0 | 0 | 7.3 | 10.2 |
| 19 | PSAeMn 60/15/5/20 | 100/0 | 0 | 0 | 7.4 | 6.9 |
| 20 | PSAeMn 60/15/5/20 | 85/15 | 0 | 0 | 7.4 | 6.5 |
| 21 | PSAeMn 60/15/5/20 | 80/20 | 0 | 0 | 7.4 | 8.7 |
| 22 | PSAeMn 50/35/5/10 | 100/0 | 7+ | ⅓ | 6.7 | 6.4 |
| 23 | PSAeMn 50/35/5/10 | 85/15 | 7 | 1 | 7.1 | 7.2 |
| 24 | PSAeMn 50/35/5/10 | 80/20 | 3 | 1 | 7.1 | 8.0 |
| 25 | BSAe 50/45/5 | 100/0 | 0 | 7+ | 8.1 | 7.7 |
| 26 | BSAe 50/45/5 | 85/15 | 0 | 7+ | 7.5 | 7.2 |
| 27 | BSAe 50/45/5 | 80/20 | 0 | 7+ | 7.4 | 7.0 |
| 28 | PMmAeMn 60/15/5/20 | 100/0 | 0 | 0 | 8.4 | 13.5 |
| 29 | PMmAeMn 53/26/5/16 | 100/0 | 0 | 0 | 8.4 | 13.5 |
| 30 | PMmAeMn 65/20/5/10 | 100/0 | ⅓ | 0 | 8.2 | 8.5 |
| 31 | PMmAeMn 55/25/5/10 | 100/0 | ⅓ | 0 | 7.8 | 8.1 |
| 32 | PKAeMn 60/15/5/20 | 100/0 | 7+ | 1 | 7.8 | 7.6 |

Adhesion rating scale:
0 = no failures
⅓ = trace
1 = slight
3 = moderate
7 = severe
7+ = complete failure As shown by the data in Table I, the hydrophilic/hydrophobic balance is important to simultaneously obtain excellent barrier performance, that is no change in resistivity after processing, and good adhesion to the gelatin overcoat. Monomers such as butyl acrylate, ethyl acrylate, butyl methacrylate and styrene contribute to increased hydrophobicity, while monomers such as 2-aminoethyl methacrylate hydrochloride and 2-hydroxyethyl methacrylate contribute to increased hydrophilicity. Hydrophilicity also increases with increasing ratio of gelatin to latex. Particularly good results were achieved in examples 10, 16, 19, 20, 30 and 31. Formulations which were either excessively hydrophilic or excessively hydrophobic did not give satisfactory results.

EXAMPLE 33

An antistatic layer was prepared in the same manner as in examples 1-32 and overcoated with the barrier layer of Example 16 at dry weight coverages of 250, 500 and 750 miligrams per square meter. The internal resistivity at 20% relative humidity was determined for each test sample before and after treatment with the developing and fixing solutions. Results obtained are reported in Table II below.

TABLE II

| Test Sample No. | Barrier Layer Coverage ($mg/m^2$) | Internal Resistivity (log ohms/square) Before Processing | After Processing |
|---|---|---|---|
| 1 | 250 | 7.3 | 7.5 |
| 2 | 500 | 7.0 | 6.7 |
| 3 | 750 | 7.1 | 7.3 |

The results reported in Table II indicate that a barrier layer coverage as low as $250/mg/m^2$ provides effective permanent antistatic protection.

EXAMPLES 34-72

An aqueous antistatic formulation comprised of 0.016 weight percent silver-doped vanadium pentoxide, 0.048 weight percent of a terpolymer latex of vinylidene chloride (83 mole %), methyl acrylate (15 mole %) and itaconic acid (2 mole %) and 0.01 weight percent of a p-nonyl phenoxy polyglycidol wetting agent available commercially as OLIN 10G SURFACTANT was coated onto a polyethylene terephthalate film support that had been subbed with a terpolymer latex of acrylonitrile, vinylidene chloride and acrylic acid. The coating was dried to form an antistatic layer with a dry weight coverage of approximately 9 milligrams per square meter.

A barrier layer was coated over the antistatic layer from aqueous formulations comprised of 5 weight percent of either latex I (a terpolymer of 83 mole % vinylidene chloride, 15 mole % methyl acrylate and 2 mole % itaconic acid) or latex II (a terpolymer of 88 mole % vinylidene chloride, 10 mole % methyl acrylate and 2 mole % itaconic acid), 0 to 30 weight percent of ethylene carbonate based on latex polymer weight, and 0 to 0.2 percent based on total weight of the formulation of OLIN 10G SURFACTANT. The barrier layer was coated in an amount sufficient to give a dry weight coverage of 500 to 800 milligrams per square meter. A gel subbing layer was coated over the barrier layer at a dry weight of 60 milligrams per square meter.

The test samples were evaluated for permanence of the antistatic properties after processing in conventional photographic developing and fixing solutions. To check the permanence of the antistatic properties, the internal resistivity (at 20% relative humidity) of the test sample was measured before and after treatment in the developing and fixing solutions. The results obtained are reported in Table III below.

TABLE III

| Example No. | Barrier Latex | Barrier Coverage (mg/m²) | % Ethylene Carbonate | % Wetting Agent | Internal Resistivity (log ohms/square) Before Processing | After Processing |
|---|---|---|---|---|---|---|
| Control | None | — | — | — | 8.2 | >14 |
| 34 | I | 500 | 10 | 0 | 8.2 | >14 |
| 35 | I | 550 | 10 | 0 | 8.2 | >14 |
| 36 | I | 600 | 10 | 0 | 8.4 | 10.1 |
| 37 | I | 650 | 10 | 0 | 8.2 | 10.5 |
| 38 | I | 700 | 10 | 0 | 8.3 | 10.1 |
| 39 | I | 600 | 15 | 0.075 | 7.9 | 7.9 |
| 40 | I | 700 | 15 | 0.075 | 7.8 | 7.7 |
| 41 | I | 500 | 20 | 0 | 8.0 | >14 |
| 42 | I | 550 | 20 | 0 | 8.1 | 10.1 |
| 43 | I | 600 | 20 | 0 | 8.2 | 9.7 |
| 44 | I | 600 | 20 | 0.075 | 7.5 | 7.5 |
| 45 | I | 650 | 20 | 0 | 8.4 | 9.0 |
| 46 | I | 700 | 20 | 0 | 8.3 | 8.4 |
| 47 | I | 700 | 20 | 0.075 | 7.6 | 7.6 |
| 48 | I | 700 | 20 | 0.100 | 8.4 | 9.4 |
| 49 | I | 700 | 20 | 0.150 | 8.4 | >14 |
| 50 | I | 700 | 20 | 0.200 | 8.2 | >14 |
| 51 | I | 800 | 20 | 0.075 | 7.6 | 7.5 |
| 52 | I | 800 | 20 | 0.100 | 7.8 | 10.9 |
| 53 | I | 800 | 20 | 0.150 | 7.9 | >14 |
| 54 | I | 600 | 25 | 0.075 | 7.8 | 7.8 |
| 55 | I | 700 | 25 | 0.075 | 7.8 | 7.8 |
| 56 | I | 700 | 25 | 0.100 | 7.9 | 10.1 |
| 57 | I | 700 | 25 | 0.150 | 7.9 | >14 |
| 58 | I | 800 | 25 | 0.100 | 7.9 | 9.9 |
| 59 | I | 800 | 25 | 0.150 | 7.8 | >14 |
| 60 | I | 500 | 30 | 0 | 8.4 | 9.7 |
| 61 | I | 550 | 30 | 0 | 8.3 | 8.2 |
| 62 | I | 600 | 30 | 0 | 8.4 | 8.7 |
| 63 | I | 600 | 30 | 0.075 | 7.6 | 7.5 |
| 64 | I | 650 | 30 | 0 | 8.4 | 8.5 |
| 65 | I | 700 | 30 | 0 | 8.5 | 8.5 |
| 66 | I | 700 | 30 | 0.075 | 7.9 | 7.8 |
| 67 | I | 700 | 30 | 0.100 | 8.4 | 10.6 |
| 68 | I | 700 | 30 | 0.150 | 8.2 | >14 |
| 69 | I | 800 | 30 | 0.100 | 8.2 | 9.5 |
| 70 | I | 800 | 30 | 0.150 | 8.0 | >14 |
| 71 | II | 400 | 0 | 0.050 | 8.6 | 8.3 |
| 72 | II | 800 | 0 | 0.050 | 8.7 | 8.7 |

As indicated by the data in Table III, the achievement of permanent antistatic properties, that is, no change in resistivity after processing, is affected by the barrier layer coverage, the concentration of coalescing agent and the concentration of wetting agent. Barrier layer coverage of 600 milligrams per square meter or greater and ethylene carbonate concentrations of 15 to 30 percent are preferred. Excessively low concentrations of the wetting agent, that is, less than 0.03%, result in poor coatability of the barrier formulation. At excessively high concentrations of the wetting agent, that is, greater than 0.1%, it is believed that coalescence of the latex is hindered by the stabilizing effect of the wetting agent. Under these conditions, the poorly formed barrier layer allows the processing solutions to diffuse to the underlying antistatic layer and dissolve the conductive vanadium pentoxide. Examples illustrating this effect are examples 49, 50, 53, 57, 59, 68 and 70.

EXAMPLES 73-74

The antistatic layer and barrier layer were prepared in the same manner as described hereinabove in reference to examples 34-72, but each sample was overcoated with a gelatin anti-curl layer containing yellow, magenta and blue anionic soluble dyes. The samples were processed, and their visual and ultraviolet $D_{min}$ values were measured on a densitometer. The samples were also analyzed spectrophotometrically to evaluate dye stain. Dry and wet adhesion of the anti-curl layer was measured as described hereinabove. The results obtained are reported in Table IV below.

TABLE IV

| Example No. | Barrier Latex | Barrier Coverage (mg/m²) | % Ethylene Carbonate | % Wetting Agent | *Dry Adhesion | *Wet Adhesion | $D_{min}$ UV | Visible |
|---|---|---|---|---|---|---|---|---|
| Control 1 | None | — | — | — | 0 | 0 | 0.038 | 0.017 |
| Control 2 | ** | 550 | — | — | 0 | 0 | 0.107 | 0.088 |
| 73 | I | 500 | 20 | 0.075 | 0 | 0 | 0.040 | 0.017 |
| 74 | I | 750 | 20 | 0.075 | 0 | 0 | 0.041 | 0.018 |

*On the adhesion rating scale, 0 represents no adhesion failure.
**The latex employed in the barrier layer in this control test was poly(ethyl acrylate-co-styrene-co-2-aminoethyl methacrylate hydrochloride-co-2-hydroxyethyl methacrylate).

As shown by the data in Table IV, Control 2 exhibited a significant degree of dye stain (absorption peaks occurred at 540 nm for retained magenta dye and 450 nm for retained yellow dye), whereas examples 73 and 74 provided $D_{min}$ values comparable to Control 1.

As shown by the data provided herein, use of the combination of an antistatic layer comprising a vanadium pentoxide antistatic agent and an overlying barrier layer comprising a latex polymer having hydrophilic functionality provides a combination of benefits not previously achievable in the prior art. In particular, it provides permanent antistatic protection as well as excellent adhesion in instances where there is an overlying curl control layer or silver halide emulsion layer. When the photographic element is one which contains anionic dyes in emulsion layers or curl control layers, optimum results are achieved by preparing the barrier layer from a vinylidene chloride-containing polymer having carboxyl functional groups, since such polymers are capable of providing good adhesion and good barrier properties and have the further advantage that they do not adversely interact with anionic dyes, so the problem of dye stain is effectively avoided.

The invention has been described in detail with particular reference to preferred embodiments thereof, but it will be understood that variations and modifications can be effected within the spirit and scope of the invention.

What is claimed is:

1. A multilayer material useful as a base for a photographic element, said material comprising a support having thereon an antistatic layer comprising vanadium pentoxide in an amount sufficient to function as an antistatic agent and an overlying barrier layer comprised of a latex polymer in an amount sufficient to retard diffusion of said vanadium pentoxide, said latex polymer having hydrophilic functionality sufficient to render said barrier layer receptive to an aqueous coating composition applied thereto so that a layer formed from said aqueous coating composition is strongly adherent to said barrier layer.

2. A meterial as claimed in claim 1 wherein said support is a polyester film.

3. A material as claimed in claim 1 wherein said support is a polyethylene terephthalate film.

4. A material as claimed in claim 1 wherein said support is a cellulose ester film.

5. A material as claimed in claim 1 wherein said support is a resin-coated paper.

6. A material as claimed in claim 1 wherein said vanadium pentoxide is doped with silver.

7. A material as claimed in claim 1 wherein said barrier layer additionally comprises gelatin.

8. A material as claimed in claim 1 wherein said latex polymer is a copolymer of (1) one or more polymerizable monomers selected from the group consisting of styrene, alkyl acrylates and alkyl methacrylates with (2) one or more substituted polymerizable monomers selected from the group consisting of styrenes, alkyl acrylates and alkyl methacrylates that have been substituted with an aminoalkyl salt group or an hydroxyalkyl group.

9. A material as claimed in claim 1 wherein said latex polymer is selected from the group consisting of:

poly(ethyl acrylate-co-2-aminoethyl methacrylate hydrochloride-co-2-hydroxyethyl methacrylate)

poly(ethyl acrylate-co-styrene-co-2-aminoethyl methacrylate hydrochloride), poly(ethyl acrylate-co-styrene-co-2-aminoethyl methacrylate hydrochloride-co-2-hydroxyethyl methacrylate), poly(butyl acrylate-co-styrene-co-2-aminoethyl methacrylate hydrochloride), poly(ethyl acrylate-co-methyl methacrylate-co-2-aminoethyl methacrylate hydrochloride-co-2-hydroxyethyl methacrylate), and poly(ethyl acrylate-co-butyl methacrylate-co-2-aminoethyl methacrylate hydrochloride-co-2-hydroxyethyl methacrylate).

10. A multilayer material useful as a base for a photographic element, said material comprising a polyester film having thereon an antistatic layer comprising vanadium pentoxide in an amount sufficient to function as an antistatic agent and an overlying barrier layer comprised of a latex polymer in an amount sufficient to retard diffusion of said vanadium pentoxide, said latex polymer having hydrophilic functionality sufficient to render said barrier layer receptive to an aqueous coating composition applied thereto so that a layer formed from said aqueous coating composition is strongly adherent to said barrier layer, said latex polymer comprising poly(ethylacrylate-co-styrene-co-2-aminoethyl methacrylate hydrochloride-co-2-hydroxyethyl methacrylate).

11. A material as claimed in claim 1 wherein said latex polymer is a vinylidene chloride-containing polymer having carboxyl functional groups.

12. A material as claimed in claim 11 wherein said latex polymer contains at least 50 mole percent of vinylidene chloride.

13. A material as claimed in claim 11 wherein said latex polymer contains at least 70 mole percent of vinylidene chloride.

14. A material as claimed in claim 11 wherein said latex polymer is a terpolymer of vinylidene chloride, acrylonitrile and acrylic acid.

15. A material as claimed in claim 11 wherein said latex polymer is a terpolymer of vinylidene chloride, methyl acrylate and itaconic acid.

16. A material as claimed in claim 11 wherein said latex polymer is a terpolymer of 70 to 90 mole % vinylidene chloride, 5 to 25 mole % methyl acrylate and 1 to 10 mole % itaconic acid.

17. A material as claimed in claim 11 wherein said barrier layer additionally comprises a coalescing agent for said latex polymer and a wetting agent.

18. A material as claimed in claim 11 wherein said barrier layer additionally comprises 15 to 30% of ethylene carbonate based on the weight of said latex polymer.

19. A material as claimed in claim 11 wherein said barrier layer additionally comprises ethylene carbonate and a p-nonyl phenoxy polyglycidol.

20. A multilayer material useful as a base for a photographic element, said material comprising a polyester film having thereon an antistatic layer comprising vanadium pentoxide in an amount sufficient to function as an antistatic agent and an overlying barrier layer comprises of (1) a latex polymer in an amount sufficient to retard diffusion of said vanadium pentoxide, said latex polymer having hydrophilic functionality sufficient to render said barrier layer receptive to an aqueous coating composition applied thereto so that a layer formed from said aqueous coating composition is strongly adherent to said barrier layer, said latex polymer comprising a terpolymer of vinylidene chloride, methyl acrylate and itaconic acid, (2) ethylene carbonate in an amount sufficient to serve as a coalescing agent and (3) a p-nonyl phenoxy polyglycidol in an amount sufficient to improve coatability of the composition forming said barrier layer.

* * * * *